US006084529A

United States Patent [19]

Lee et al.

[11] Patent Number: 6,084,529

[45] Date of Patent: Jul. 4, 2000

[54] DEVICE AND METHOD OF PROCESSING A RADIO PAGING MESSAGE IN A PORTABLE TERMINAL

[75] Inventors: Jin-Chul Lee, Ahnyang; Dong-Hoon Shin, Seoul, both of Rep. of Korea

[73] Assignee: Samsung Electronics Co., Ltd., Kyungki-Do, Rep. of Korea

[21] Appl. No.: 08/808,182

[22] Filed: Feb. 28, 1997

[30] Foreign Application Priority Data

Feb. 29, 1996 [KR] Rep. of Korea ..... 96-5335

[51] Int. Cl.[7] ..... G08B 5/22

[52] U.S. Cl. ..... 340/825.44; 340/825.44; 455/38.1; 455/38.3

[58] Field of Search ..... 455/575; 340/825.44, 340/825.37, 825.4, 825.52, 825.69, 825.72, 825.04, 825.07, 825.12

[56] References Cited

U.S. PATENT DOCUMENTS

| | | | |
|---|---|---|---|
| 4,855,731 | 8/1989 | Yoshizawa et al. | 340/825.44 |
| 5,258,751 | 11/1993 | DeLuca et al. | 340/825.44 |
| 5,459,458 | 10/1995 | Richardson et al. | 340/825.52 |

*Primary Examiner*—Michael Horabik
*Assistant Examiner*—Anthony A. Asongwed
*Attorney, Agent, or Firm*—Sughrue, Mion, Zinn, Macpeak & Seas, PLLC

[57] ABSTRACT

A method and apparatus for processing a radio paging message in portable terminal, which is capable of receiving a message, where the terminal apparatus comprises a memory and a touch panel which includes an indicator at a fixed site. The method comprises: receiving the radio paging message; interrupting a current operation in response to the reception of the message, storing the received message in the memory, recording that the stored message is not read, and resuming the interrupted operation; accessing the memory and controlling the indicator to periodically flicker with the presence of the unread data; and reading and displaying the corresponding data with the detection of an indicator touch responding to the indicator flickering, and controlling the indicator to cease flickering in accordance with the detection of the indicator touch. It may be concluded that the radio paging function applied in a portable terminal as an additional function enables the user to be informed of the reception of a message and to access the received message only when desired without interrupting a current operation of the portable terminal.

10 Claims, 4 Drawing Sheets

DEVICE AND METHOD OF PROCESSING A RADIO PAGING MESSAGE IN A PORTABLE TERMINAL

BACKGROUND OF THE INVENTION

1. Field of the Invention

The present invention relates to a device and a method of processing a radio paging message in a wireless communication system. More particularly, the invention relates to a device and a method of notifying a user of a portable terminal of a wireless call signal received in the terminal without unduly interrupting a current operation of the terminal. The present application is based on Korean Application No. 05335/1996, which is incorporated herein by reference.

2. Description of the Related Art

A radio call receiver called "a pager" is a device for receiving a simple message and comprises a receiving unit, an alarm section, a display, and a memory.

FIG. 1 exemplifies a pager comprising a digital display, a memory and the like with its detailed construction and operation described in U.S. Pat. No. 4,197,526. Upon reception of a message signal through an antenna 15, the message signal is decoded in a radio detector and modulator 23 and amplified in an amplifier 24. The amplified message drives a beeper 17 to audibly inform the user of the reception of the message. A display 18 presents the amplified message in a visual form. When the user fails to respond to the incoming message signal after a designated time, the message on the display becomes erased by means of an automatic time delay unit 25, and the message is stored in a memory 26. The stored message (in a character or a numeric form) can be displayed again in response to the user's request.

A portable terminal includes additional functions, e.g. computing functions, in addition to the paging operating described above. Unlike a conventional pager, in a portable terminal, it is not necessary to display a message immediately after the message has been received. With the immediate notification and display, a current operation of the terminal is likely to be interrupted without the user's approval when the message is immediately displayed. The unexpected interruption may confuse a user, causing the user to make a mistake during the current operation. Therefore, it is preferable to avoid such interruptions except in emergency situations.

SUMMARY OF THE INVENTION

An object of the present invention is to provide a device and a method of informing a user of a wireless call signal received in a portable terminal while minimizing the interruption of a current operation of the terminal.

To achieve the advantages of the present invention, the method of processing a radio paging message in a portable terminal, where the portable terminal is capable of receiving a message and includes a memory and a touch panel which includes an indicator at a fixed site, comprises:

receiving the radio paging message;

interrupting a current operation in response to the reception of the radio paging message, storing the received radio paging message in the memory, indicating that the stored message is not read;

resuming the interrupted current operation;

checking the memory and controlling the indicator to flicker with the presence of unread data stored in the memory;

reading and displaying the unread data in accordance with the detection of an indicator touch in response to the indicator flickering; and controlling the indicator to cease flickering in accordance with detection of the indicator touch.

It is to be understood that both the foregoing general description and the following detailed description are exemplary and explanatory, and the following is intended to provide an explanation of the invention as claimed. However, the invention is not to be limited to the following detailed descriptions.

DETAILED DESCRIPTION OF THE PREFERRED EMBODIMENT

Detailed descriptions of the preferred embodiments of the present invention will be provided with reference to the examples illustrated in the accompanying drawings.

Figure 1:
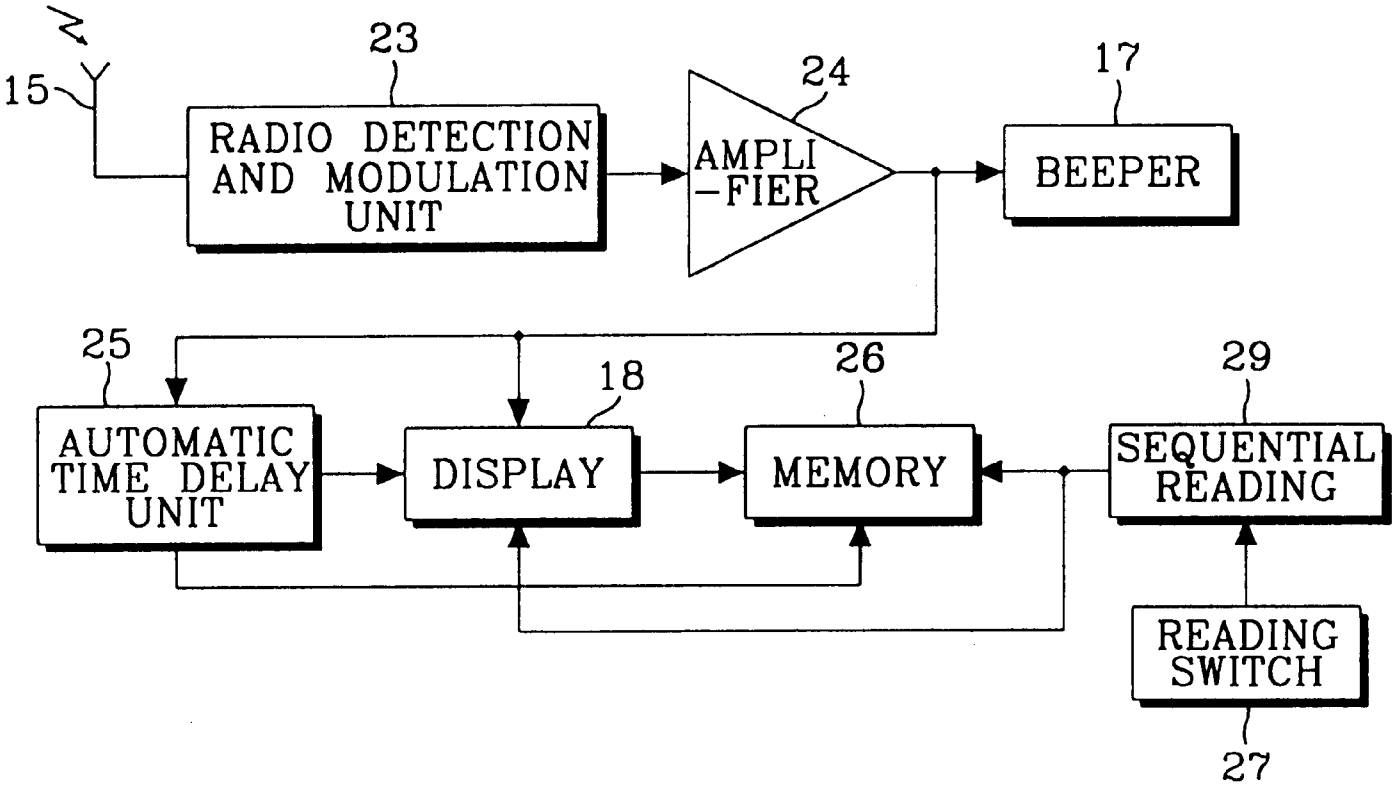
Fig. 1 PRIOR ART
FIG. 1 shows a schematic view of a general pager.
Figure 2:
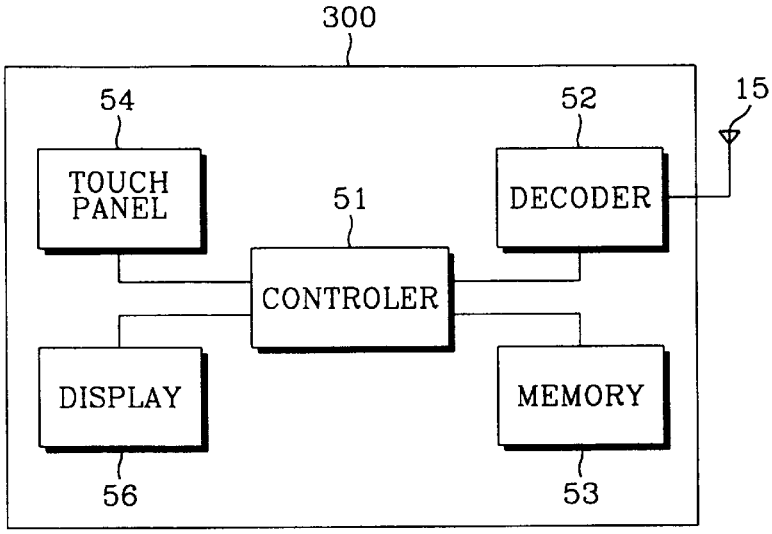
FIG. 2 shows a schematic sectional view of the portable terminal according to the present invention.
Figure 3:
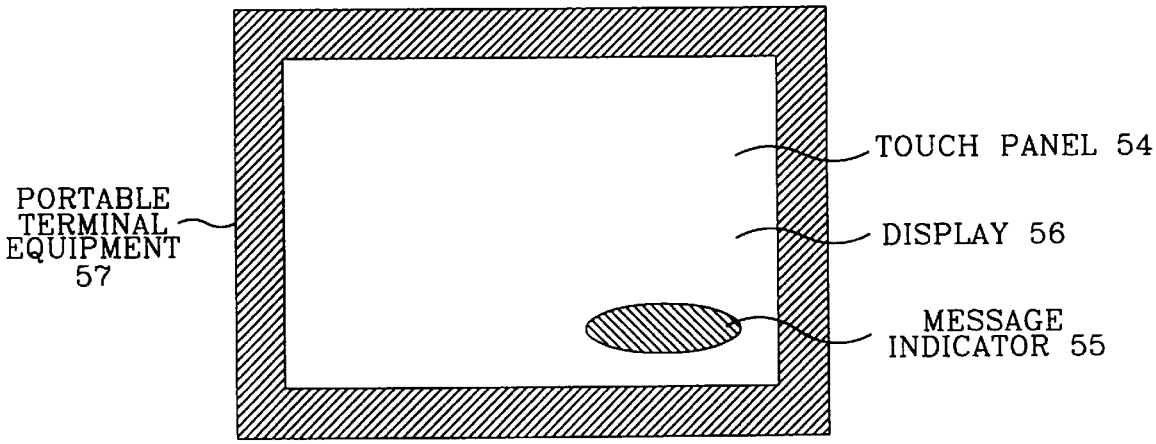
FIG. 3 shows a picture of the portable terminal according to the present invention.

FIG. 2 shows a schematic sectional view of the portable terminal according to the present invention. An antenna 15 is one kind of receiver for receiving a radio paging message, and a decoder 52 generates an interrupt signal in response to the reception of the message and decodes the received message. In a memory 53, a plurality of blocks are assigned. Each block comprises a data region for storing the radio paging message and a flag region for recording whether each stored data is read or not. A display 56 processes the results of all kinds of data or commands in the portable terminal so as to display them. An indicator is disposed at a fixed site on the display 56 as shown in FIG. 3 and described below. In the preferred embodiment, the indicator is a graphic image for reminding the user of a received paging signal. A touch panel 54 mounted on the display 56 comprises a piezoelectric element and recognizes input data on x and y coordinates. Other elements may also be used for the touch panel.

A controller 51 collectively controls the radio paging function of the portable terminal as follows. On receiving an input interrupt signal from the decoder 52, the controller 51 briefly interrupts a current operation long enough to store the message information and indicate that the message is unread. After storing the decoded data in the memory 53 and recording that the stored message is not read in a corresponding flag region of the memory, the controller 51 resumes the interrupted operation. Additionally, the controller periodically accesses the respective blocks of the memory 53 and controls the indicator to flicker with the presence of the unread data. If the controller senses an indicator touch in response to the flickering indicator, the controller reads and controls the corresponding data to be displayed on the touch panel 54 and then controls the indicator not to flicker any more. The flickering of the indicator means that the graphic image of the indicator is periodically transformed so as to be easily recognizable to the user.

FIG. 3 illustrates the portable terminal according to the present invention, the indicator 55 is disposed at a fixed site of the display 56. The indicator 55 flickers when the message is received. If the user directly presses down on this flickering indicator 55, the touch panel 54 recognizes the coordinate values. After the controller 51 recognizes that the coordinate values match the indicator location, the controller temporarily interrupts a current operation in response to the touch, displays the received message on the touch panel 54, and stops the flickering.

Figure 4:
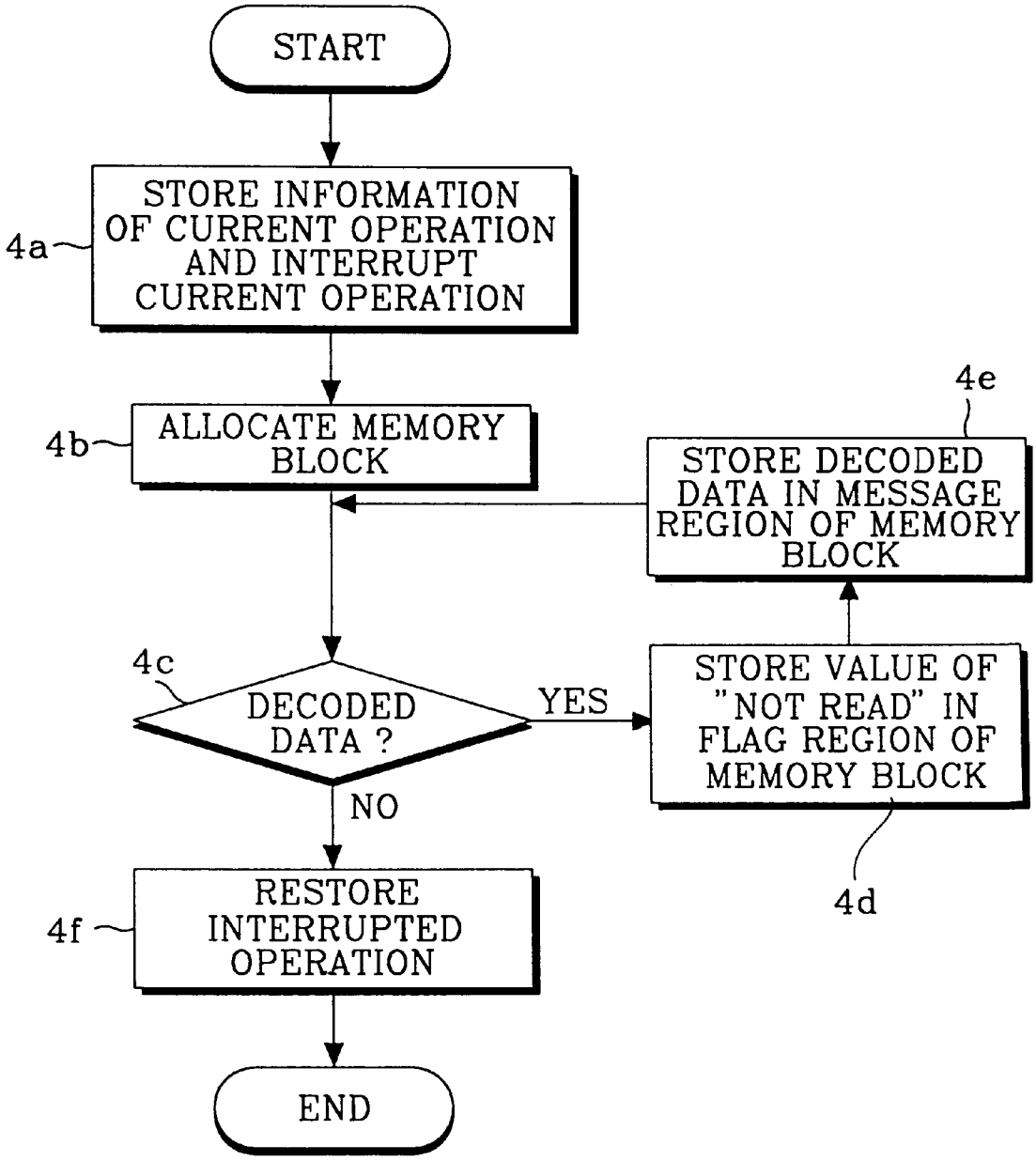
FIG. 4 is a flow chart illustrating the interruption process upon receipt of a paging message according to the present invention.
Figure 5:
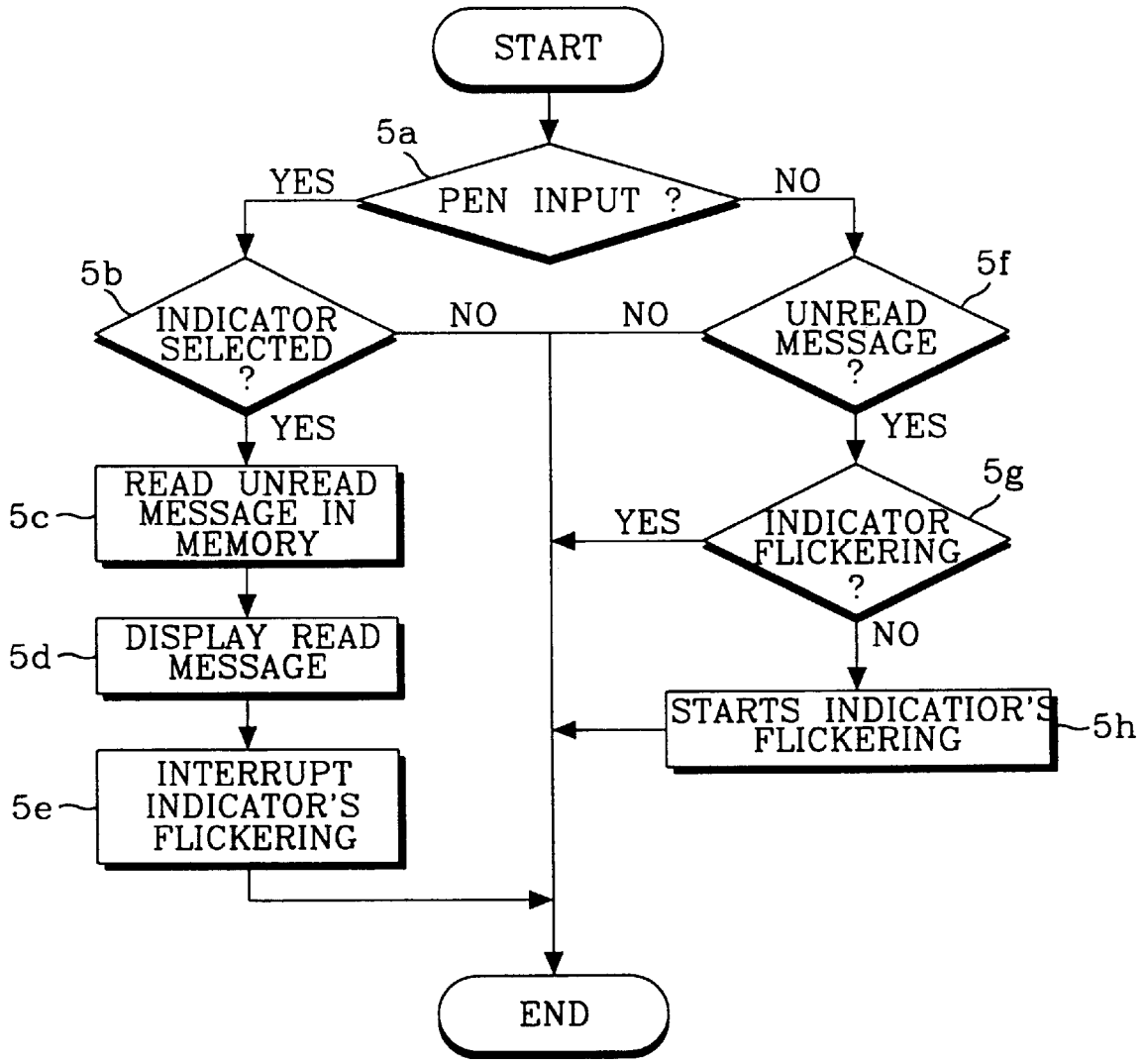
FIG. 5 is a flow chart illustrating the method of processing a paging message according to the present invention.

FIG. 4 and FIG. 5 are flow charts illustrating the interruption process for a paging message and the method of processing a paging message according to the present invention, respectively. FIG. 5 illustrates the processes of the controller for confirming the presence of an unread message, and the selection of the indicator. Operations in each step of FIG. 4 and FIG. 5 are described in detail as follows.

Referring to FIG. 4, on receiving a radio paging message, the decoder 52 generates an interrupt signal to the controller. In response to the interrupt signal, the controller 51 interrupts a current operation in step 4*a* and assigns a designated block to the memory 53 in step 4*b*. After that, the controller 51 checks for the presence of the decoded data in the decoder 52 in step 4*c* and then stores the data in the allocated block of the memory 53 with the decoded data in step 4*e*.

Memory blocks of a certain size are allocated to the memory 53 when the data is stored in the memory. Each memory block is divided into a data region for storing the data and a flag region for designating whether the data has been read or not. In the state 4*d*, a value indicating "not read" is stored in the flag region at the start of storing data. Then, the interrupted operation resumes in the state 4*f*.

With reference to FIG. 5, the controller 51 reads the blocks of the memory 53 where the radio paging message data are stored at either regular or random intervals. The controller then examines if the flag region has a value indicating "not read" data or not. With the presence of a "not read" value, the controller 51 causes the indicator 55 periodically flicker on the display.

The controller 51 checks whether there is an input by the user, such as a pen input, requesting the output of an unread message in step 5*a*. If there is no pen input, the controller 51 reads the flag region corresponding to each block of the memory 53 to determine the presence of an unread message in step 5*f*. When an unread message is present, the controller 51 determines if the indicator 55 is flickering in step 5*g*. Upon confirmation that the indicator 55 is not flickering, the controller 51 causes the indicator 55 start flickering in step 5*h*.

If there is a pen input in step 5*a*, the controller 51 determines whether the user presses down the site on the display showing the indicator 55 in step 5*b*. With the presence of the pen input at the indicator, the controller 51 reads the corresponding blocks of the memory to read a unread message stored therein in step 5*c*. Then, the read message is displayed in step 5*d* and the indicator 55 is controlled to stop flickering in step 5*e*.

It may be concluded that the novel radio paging function applied in portable terminal as an additional function enables the user to be informed of the reception of a message and to access the received message only when desired, whereas the conventional pager displays a received message directly after the reception of a message, or displays a ready-received message immediately after power-up.

The present invention as described above can enhance advantages of securing stability and independence of various functions in a computer device containing the combination of a pager and a computer device for performing various functions.

Therefore, it should be understood that the present invention is not limited to the particular embodiment disclosed herein as the best mode contemplated for carrying out the present invention, but rather that the present invention is as defined in the appended claims.

What is claimed is:

1. A portable terminal operable to process a radio paging message comprising:

a decoder for generating an interrupt signal in response to a reception of the radio paging message and decoding the radio paging message;

a memory including a plurality of blocks wherein each block comprises a data region for storing the radio paging message and a corresponding flag region for recording whether the corresponding stored radio paging message is read or unread;

an indicator being located on a fixed site of a touch panel display, wherein said indicator flickers in accordance with a designated control signal; and a controller, wherein said controller interrupts a current operation of the portable terminal, stores data decoded by the decoder in the data region of the memory, and records a flag in the corresponding region of the memory when the decoded data is not read upon reception of the interrupt signal from the decoder, wherein said controller accesses respective blocks of the memory and produces said designated control signal to the indicator to control the indicator to flicker with the presence of the unread data in the memory, and wherein said controller reads and displays the unread data on the touch panel in accordance with a detection of an indicator touch in response to the indicator flickering, and stops said flickering in response to the detection of the indicator touch.

2. The portable terminal of claim 1, wherein upon reception of the interrupt signal, said controller resumes said current operation of the terminal after storing said data and said flag in said memory.

3. The portable terminal of claim 2 wherein said controller accesses the respective blocks of the memory on a periodic basis.

4. The portable terminal of claim 2 further comprising an antenna for receiving the radio paging message and outputting the received message to the decoder.

5. A method of processing a radio paging message in a portable terminal, where the portable terminal is capable of receiving the radio paging message and includes a memory and a touch panel which includes an indicator at a fixed site, said method comprising:

receiving the radio paging message;

interrupting a current operation, storing the received radio paging message in the memory, indicating that the stored message is not read upon reception of the radio paging message;

resuming the interrupted current operation;

checking the memory and controlling the indicator to flicker with the presence of unread data stored in the memory;

reading and displaying the corresponding data in accordance with the detection of an indicator touch in response to the indicator flickering; and controlling the indicator to cease flickering in accordance with detection of the indicator touch.

6. The method of claim 5 wherein the memory checking step is performed periodically.

7. A portable terminal operable to process a radio paging message comprising:

a decoder for generating an interrupt signal in response to a reception of the radio paging message;

a memory including a data region for storing the radio paging message and a corresponding flag region for recording whether the corresponding stored radio paging message is unread;

an indicator, wherein said indicator operates in accordance with a designated control signal; and a controller, wherein said controller interrupts a current operation of the portable terminal, stores data of the received radio paging message in the data region of the memory, and records a flag in the corresponding flag region of the memory when the data is not read upon reception of the interrupt signal from the decoder, wherein said controller produces said designated control signal to the indicator to control the indicator operation with the presence of the unread data in the memory, and wherein said controller reads and displays the unread data to a display in accordance with a detection of an indicator touch.

8. The portable terminal according to claim 1, wherein the indicator touch corresponds to a user touch of the touch panel display.

9. The method of claim 5, wherein in indicating that the stored message is not read, a flag in memory is set to indicate that the stored message is not read; and wherein the indicator touch corresponds to a user touch of the touch panel.

10. The portable terminal according to claim 7, further comprising a touch panel display wherein the indicator touch corresponds to a user touch of a touch panel display.

* * * * *